US007975440B2

(12) United States Patent
Motosko et al.

(10) Patent No.: US 7,975,440 B2
(45) Date of Patent: Jul. 12, 2011

(54) END CAP FOR A CORRUGATED HURRICANE SHUTTER WITHIN AN H-HEADER

(76) Inventors: Stephen J. Motosko, Sarasota, FL (US); Stephen Motosko, III, Sarasota, FL (US)

( * ) Notice: Subject to any disclaimer, the term of this patent is extended or adjusted under 35 U.S.C. 154(b) by 312 days.

(21) Appl. No.: 12/148,846

(22) Filed: Apr. 23, 2008

(65) Prior Publication Data

US 2009/0266013 A1 Oct. 29, 2009

(51) Int. Cl.
*E06B 3/26* (2006.01)
*E04C 2/38* (2006.01)

(52) U.S. Cl. ..... 52/202; 52/798.1; 52/800.13; 49/62

(58) Field of Classification Search ..... 52/202, 52/203, 798.1, 800.12, 800.13, 716.8; 49/50, 49/57, 62

See application file for complete search history.

(56) References Cited

U.S. PATENT DOCUMENTS

| | | | | | |
|---|---|---|---|---|---|
| 3,478,997 | A * | 11/1969 | Goss | 248/488 |
| 3,724,078 | A * | 4/1973 | Carlin et al. | 52/177 |
| 4,179,089 | A * | 12/1979 | Parr, Jr. | 248/216.1 |
| 4,333,271 | A * | 6/1982 | DePaolo et al. | 49/464 |
| 4,369,953 | A * | 1/1983 | Greiner et al. | 256/24 |
| 4,685,261 | A | 8/1987 | Seaquist | |
| 5,152,116 | A * | 10/1992 | MacGowan | 52/473 |
| 5,477,967 | A * | 12/1995 | Voorhees et al. | 211/55 |
| 5,487,244 | A * | 1/1996 | Hill | 52/202 |
| 5,603,190 | A * | 2/1997 | Sanford | 52/202 |
| 5,619,837 | A * | 4/1997 | DiSanto | 52/798.1 |
| 6,079,168 | A * | 6/2000 | Shaver | 52/202 |
| 6,105,322 | A * | 8/2000 | Chang | 52/238.1 |
| 6,305,124 | B1 * | 10/2001 | Pennington | 49/57 |
| 6,345,476 | B1 * | 2/2002 | Hill | 52/202 |
| 6,398,193 | B1 * | 6/2002 | DeSouza | 256/65.06 |
| 2004/0107655 | A1 * | 6/2004 | Hudoba | 52/202 |
| 2005/0193651 | A1 * | 9/2005 | Kirk | 52/202 |

* cited by examiner

*Primary Examiner* — Robert J Canfield
*Assistant Examiner* — Brent W Herring
(74) *Attorney, Agent, or Firm* — Gifford, Krass, Sprinkle, Anderson & Citkowski, P.C.

(57) ABSTRACT

An end cap for an H-shaped header bar used to secure a corrugated hurricane shutter attachable to a window frame and having a generally inverted U-shaped pocket adapted in size to receive an upper margin of the hurricane shutter and the end cap at each end of the header bar. The header bar cooperates with a lower support channel also attached to the window frame to support and secure the hurricane shutter over the window. An end cap is positionable and attachable within an inner upright side of the pocket to engage with the upper corner of the hurricane shutter preventing substantial lateral expansion movement or corrugation deformation from being struck by flying objects during heavy hurricane wind.

15 Claims, 6 Drawing Sheets

END CAP FOR A CORRUGATED HURRICANE SHUTTER WITHIN AN H-HEADER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to removable storm and hurricane shutters, and more particularly to an end cap dependently engagable within each end of an upper H-header for supporting the corners of a corrugated hurricane shutter.

2. Description of Related Art

Hurricane shutters have become extremely popular and useful in the hurricane prone sections of the country. Such hurricane shutters are typically deployed prior to an area coming under the influence tropical storm and hurricane weather conditions and serve to prevent damage to the glass windows and portal doors as a result of high winds and flying debris.

An example of such a storm shutter installation is disclosed in U.S. Pat. No. 4,685,261. This invention is primarily directed to a hurricane shutter which includes a lower support channel or bracket which is readily adaptable to a range of lower sill angles to which this portion of the storm shutter is attached.

A critical aspect with respect to this type of hurricane shutter, and with all hurricane shutters, is that it must meet stringent impact testing requirements before becoming approved for use as a hurricane damage preventative. One such test such hurricane shutters must pass is to withstand substantial deformity and damage from heavy object high speed impact. It has been shown that, although the polycarbonate corrugated hurricane shutter structure is generally adequate to withstand such impact, when incorporated into conventional H-headers for support, impact in the vicinity of the upper portions of the hurricane shutter results in excessive deformation of the corrugations and expansion of those corrugations, causing the structure to fail building code testing.

The present invention affords a simple end cap structure which is positionable within each end of an upper H-header for strengthening and stabilizing the shape of the upper corners of a corrugated polycarbonate hurricane shutter to eliminate excessive corrugation deformation in the upper corner areas and lateral expansion movement of the hurricane shutter which otherwise results in failure to comply with current building code testing procedure.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to an end cap for an H-shaped header bar used to secure a corrugated polycarbonate hurricane shutter attachable to a window frame. The H-header has a generally inverted U-shaped pocket adapted in size to receive an upper margin of the hurricane shutter, with the end cap positioned in each end of the header bar. The H-header cooperates with a lower support channel also attached to the window frame to support and secure the hurricane shutter over the window. The end cap is dependently positionable within an inner upright side of the pocket to engage with the upper corner of the hurricane shutter, strengthening and preventing substantial movement from flying object impact during heavy hurricane wind conditions and building code testing therefor.

It is therefore an object of this invention to provide an end cap securable around each upper corner of a polycarbonate corrugated hurricane shutter and dependently positionable within the ends of the header to strengthen and prevent unacceptable upper corner deformation and expansion movement of the hurricane shutter during hurricane and tropical storm conditions.

It is therefore an object of this invention to provide an end cap securable around each upper corner of a polycarbonate corrugated hurricane shutter and dependently positionable within the ends of the header to strengthen and prevent unacceptable upper corner deformation and expansion movement of the hurricane shutter during hurricane and tropical storm conditions during building code testing procedures.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
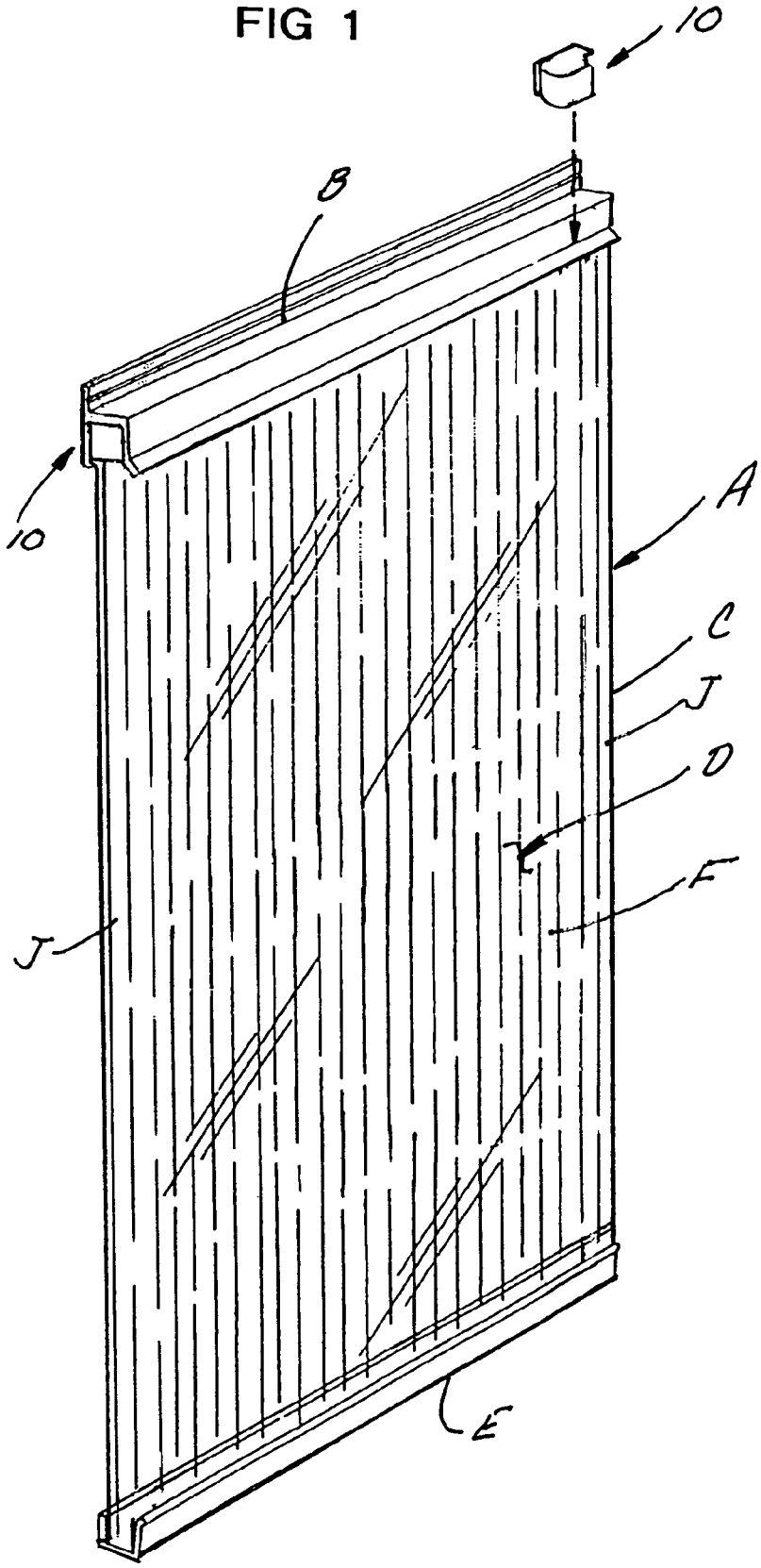
FIG. 1 is a perspective exploded view of the present invention incorporated into each end of an H-header and supporting the upper corner of a corrugated hurricane shutter.

Referring now to the drawings, and firstly to FIG. 1, a typical hurricane shutter is there shown generally at numeral A which includes a corrugated polycarbonate transparent hurricane shutter D supported along a lower horizontal margin thereof by an upright U-shaped lower channel E and, along an upper margin of the hurricane shutter D within an inverted downwardly extending H-header B.

The header B includes a pair of spaced apart side walls. The side walls are elongated in the width direction of the hurricane shutter A. An elongated traverse wall connects the pair of side walls to form the inverted downwardly extending channel. An end wall is positioned at either end of the pair of side walls to define a cavity formed in the H-header B.

Figure 2:
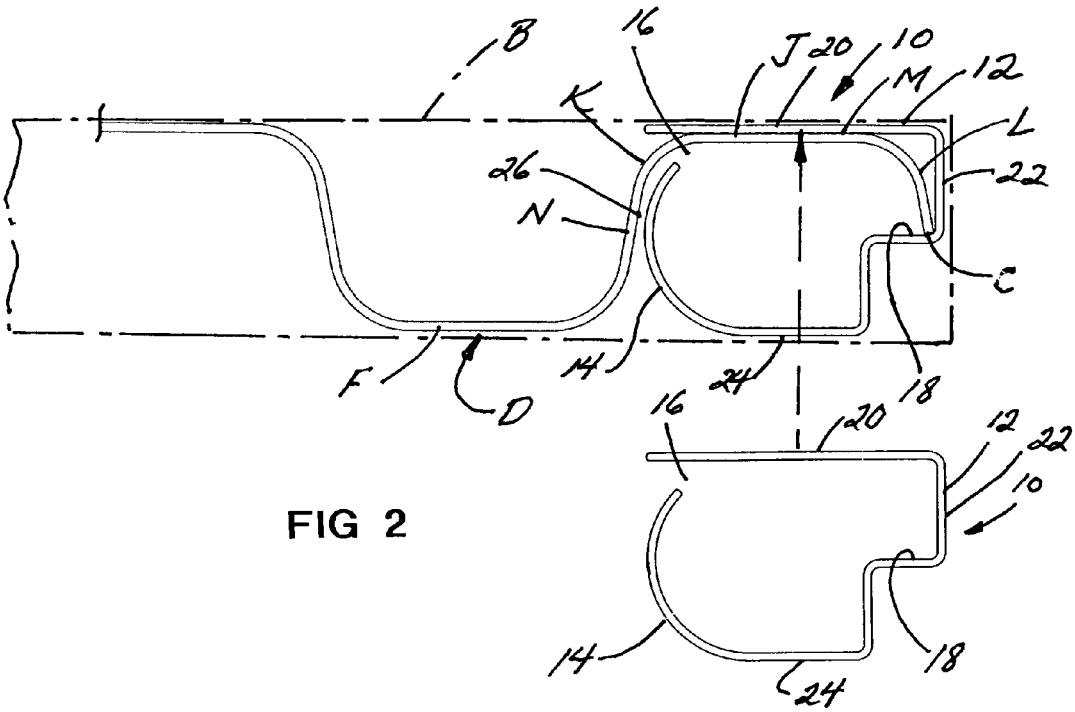
FIG. 2 is a simplified exploded top plan view of the upper right-hand corner of FIG. 1 showing the H-header in phantom.

Referring additionally to FIG. 2, absent the present invention which is shown generally at numeral 10, the corrugations F of the hurricane shutter D simply sit within the upright side walls of the header B and are somewhat free to move laterally as well as front to back absent substantial support. However, the present invention 10 is positionable within the ends of the header B and fitted downwardly and entrappingly around the upper corner of each of the edge corrugations J. Note that the end cap 10 is not shown at the lower end of the header B for simplicity, but may be added.

The end cap 10 is formed of either extruded or roll-formed thin wall plastic or sheet metal material, and preferably polycarbonate for strength having an overall width that slidably engages into the header B shown in phantom in FIG. 2. The end cap 10 includes a housing 12 having a flat front wall 24 extending into an arcuate inner side wall 14 and an outer side wall 22 having an offset forming end stop 18, the purpose of which is described herebelow. The housing 12 also includes an upright back wall 20 which, in combination with the end of the arcuate side wall 12, forms an upright access slot 16 extending over the entire height of the housing 12. The access slot 16 extends generally normal to the longitudinal direction of the pair of side walls of the header B. Further, the end cap 10 is positioned within the cavity of the H-header B adjacent the end wall.

The above housing configuration is sized and adapted to downwardly slide over the corner of the edge corrugation J as shown. The access slot 16 is slidable downwardly over the second arcuate portion K of corrugation J, the first flat corrugation J bearing against the inner surface of the back wall 20, while the first arcuate portion L terminating at edge C, bears against the end stop 18. The small gap 26 between the neutral portion N of the first corrugation provides very limited clearance or no clearance at all with a biased engagement against the arcuate portion 14 so as to establish a non-movable non-deforming arrangement laterally, while the front wall 24 and the rear wall 20 bearing against the corresponding upright sides of the H-header B prevent any fore and aft (or front-to-back) movement, thus fully entrapping the upper corner of the hurricane shutter D. Appropriate fasteners (not shown) may further interengage these mating upright front and back surfaces with the side walls of the H-header B as desired.

Figure 3:
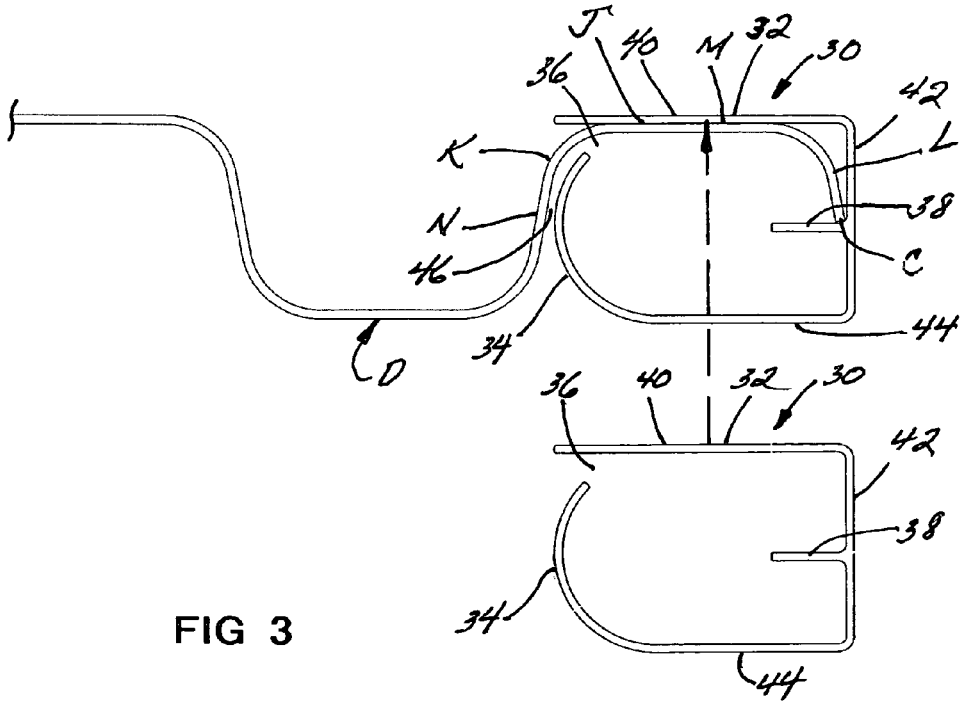
FIG. 3 is an exploded top plan view similar to FIG. 2 showing another embodiment of the invention.
Figure 4:
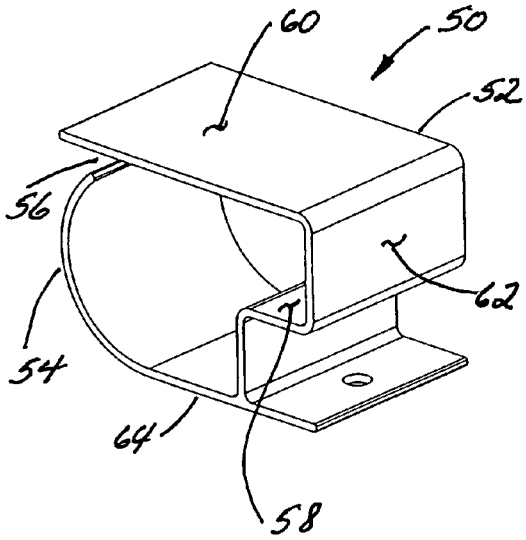
FIG. 4 is a perspective view of a third embodiment of the invention.
Figure 6:
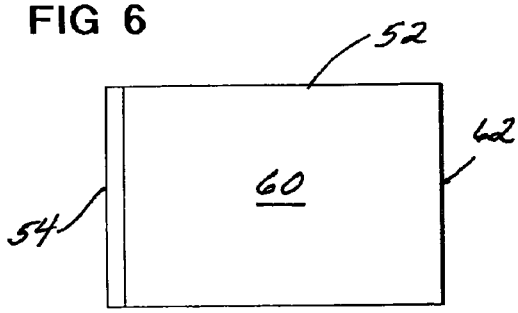
FIG. 6 is a rear elevation view of FIG. 4.
Figure 5:
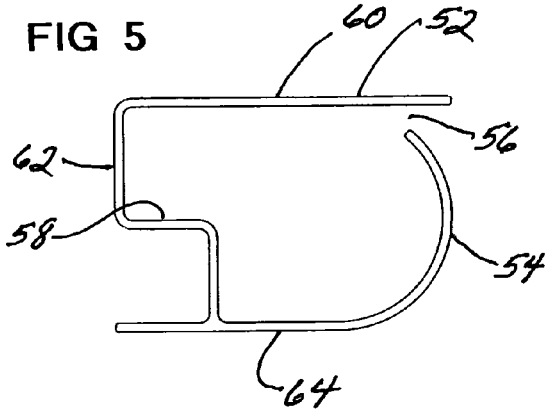
FIG. 5 is an end elevation view of FIG. 4.
Figure 7:
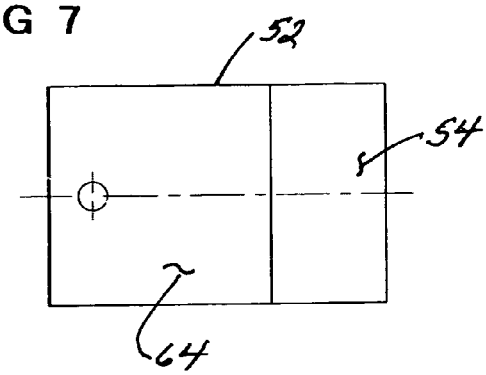
FIG. 7 is a front elevation view of FIG. 5.

Referring now to FIG. 3, a second embodiment of the invention is there shown wherein the front upright surface 44 extends across a more substantial length of the housing 32 while still maintaining an end stop 38 for supportingly bearing against the upright edge C of the hurricane shutter D. As previously described, the flat M of the first corrugation J bears against the rear upright wall 40 while the first neutral portion N is closely spaced at 46 with respect to the arcuate inner side wall 34. The outer side wall 42, in combination with stop surface 38, entraps the edge C of the hurricane shutter D.

Referring now to FIGS. 4 to 7, a third embodiment of the invention is there shown generally at numeral 50 and also includes a molded or extruded plastic or metal housing 52 having an arcuate inner side wall 54 which in combination with the upright back panel 60 forms the access slot 56 which functions as previously described. The combination of the stop surface 58 and the outer side wall 62 define an entrapment means similar to that previously described. The front upright surface 64 is again elongated similar to that shown in FIG. 3.

Referring now to FIGS. 8 to 12, a fourth embodiment of the invention is there shown generally at numeral 70 and also includes a molded plastic or metal housing 72 having an inner arcuate surface 74 blending uniformly from the front upright surface 84. The back upright surface 80 defines, in combination with the end of the inner side wall 74, the access slot 76. The front upright wall 84 is of a length similar to that in FIG. 3, while the combination of outer upright side wall 82 and stop surface 78 define the entrapment means for the edge C of the upper corner of the hurricane shutter D as previously described. In this embodiment of the housing 72, a solid top surface 86 is also provided as an end stop for the upper end corner of the first corrugation J of the hurricane shutter D for added stability.

Figure 8:
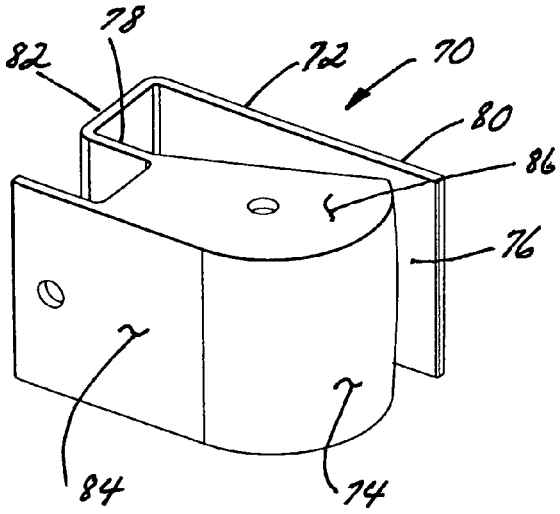
FIG. 8 is a perspective view of a fourth embodiment of the invention.
Figure 9:
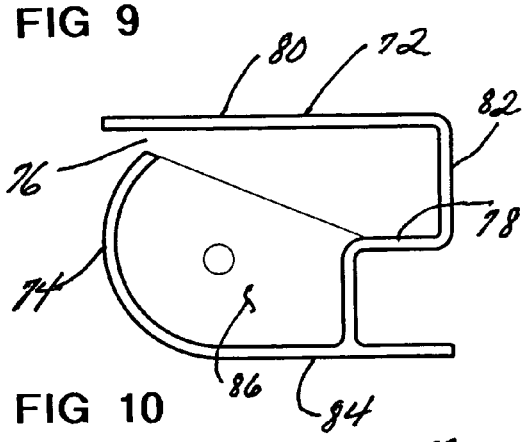
FIG. 9 is an end elevation view of FIG. 8.
Figure 12:
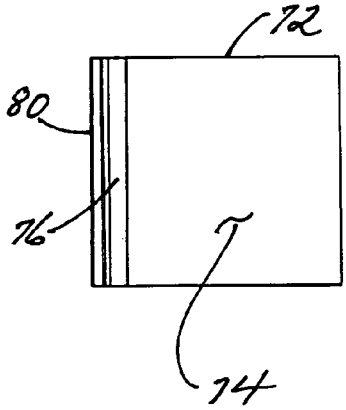
FIG. 12 is a side elevation view of FIG. 8.
Figure 10:
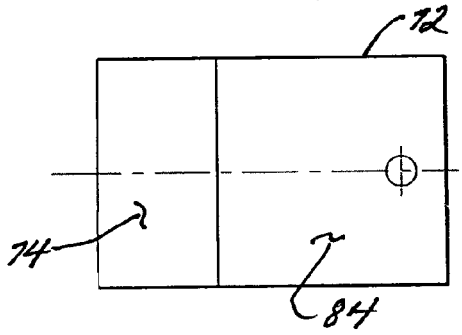
FIG. 10 is a front elevation view of FIG. 8.
Figure 11:
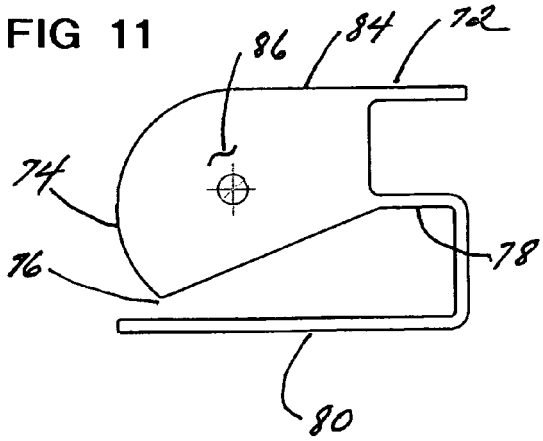
FIG. 11 is another end elevation view of FIG. 8.
Figure 8A:
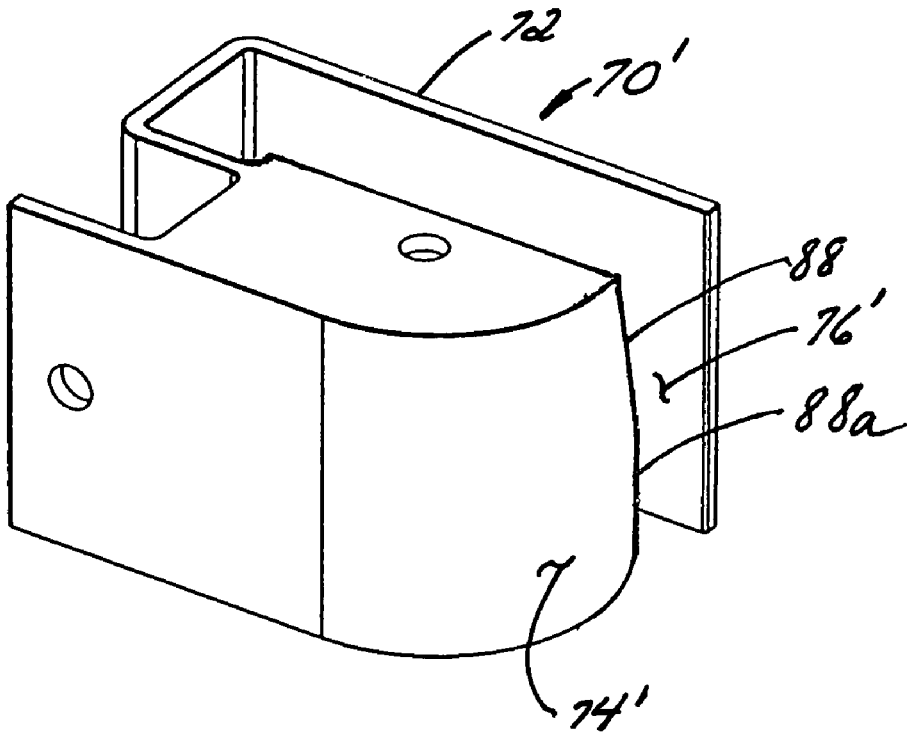
FIGS. 8A and 12A show an alternate embodiment to that shown in FIGS. 8 and 12.
Figure 12A:
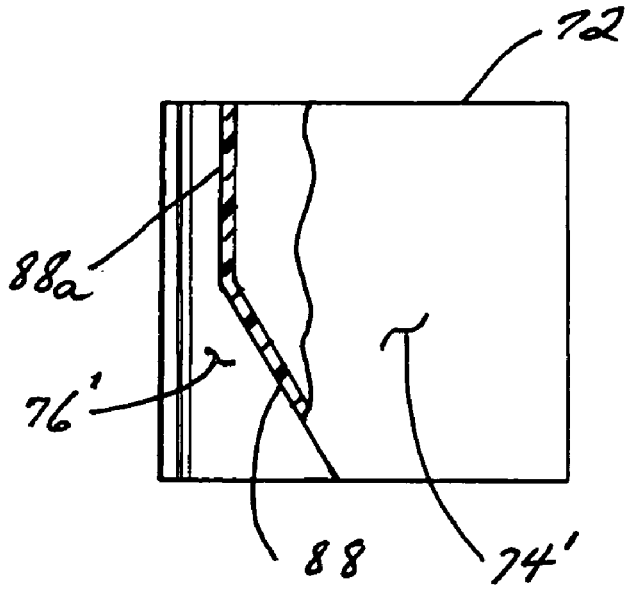
Figure 13:
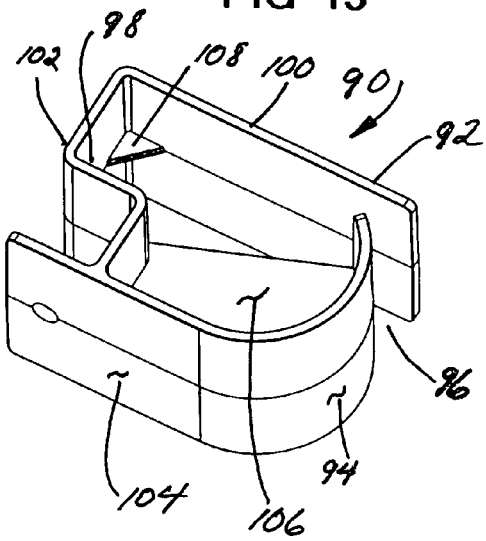
FIG. 13 is a perspective view of a fifth embodiment of the invention.
Figure 14:
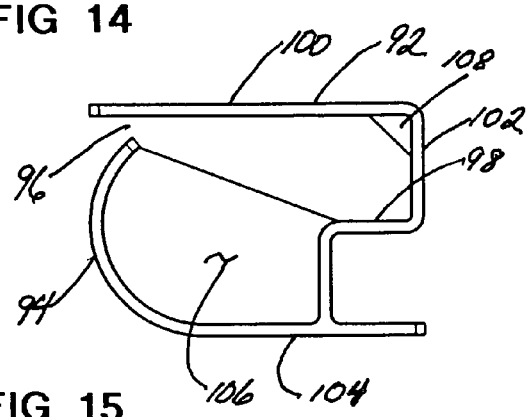
FIG. 14 is a top plan view of FIG. 13.
Figure 15:
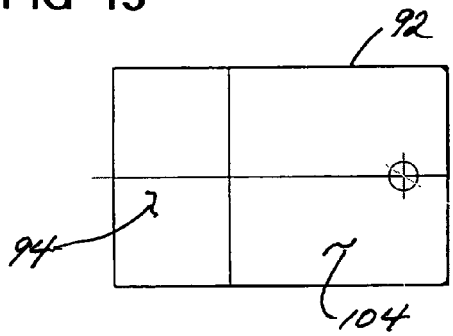
FIG. 15 is a front elevation view of FIG. 14.
Figure 16:
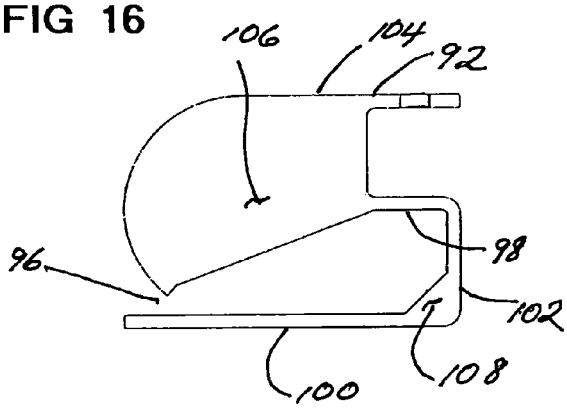
FIG. 16 is a bottom plan view of FIG. 14.

FIGS. 8A and 12A show an alternate embodiment of the invention shown at numeral 70 in FIGS. 8 and 12. This embodiment 70' includes all of the features previously described in FIGS. 8 and 12 with respect to embodiment 70, except for the addition of a lead-in ramp 88 which extends diagonally into panel 88*a*. This enlarges the size and breadth of the slot 76' defined from the inner arcuate surface 74'. This lead-in ramp 88 and enlarged access slot 76' greatly facilitate the assembly of this embodiment 70' over the upper corner of the corrugated panel D.

Referring lastly to FIGS. 13 to 16, a fifth embodiment is there shown at numeral 90 having a molded plastic or metal thin wall housing 92 similar to that previously described. The front upright surface 104 blends into the convex arcuate inner side wall surface 94 and, in combination with the upright back wall 100, defines the corrugation access slot 96 for the upper corner of the corrugated hurricane shutter D as previously described.

In this embodiment 90, the housing 92 includes a reinforcing gusset 108 which does not interfere with the entrapment functioning of the outer end wall 102 in combination with the stop surface 98. A panel 106 is positioned centrally along the height of this embodiment 92 which bears against the upper end of either of the corners of the corrugated hurricane shutter D so as to achieve ambidextrous structure, that is, this embodiment 90 will fit on either upper end of the corners of the hurricane shutter D.

All of the above described embodiments provide two important strengthening and building code qualifying aspects necessary for these polycarbonate corrugated hurricane shutters to both meet building code requirements and to adequately protect the contents and people within a so-protected building window structure. The first aspect is with respect to the deformation of the corner areas of the corrugated storm shutter which otherwise occurs causing test failure when struck by a high impact flying object. Additionally, when the corrugated hurricane shutter is struck in a central upper portion, the collapse of the corrugations in the impact area has been shown to otherwise lead to the lateral expansion of the structure in the vicinity of the upper corners causing test failure as well. The present invention both restrains the upper corners from corrugation deformation and restrains the overall corrugation structure from excessive lateral expansion by semi-rigidly restraining these corner areas from such outward lateral movement.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A hurricane shutter assembly for protecting an opening from impact damage, said hurricane shutter assembly comprising:

an elongated header having a pair of spaced apart elongated side walls, a traverse wall connecting said pair of side walls, and an end wall positioned at either end of said pair of side walls to define a cavity;

a corrugated hurricane shutter having an edge, said corrugated hurricane shutter having a portion thereof being received within said cavity of said header; and an end cap positioned within said cavity of said header adjacent said end wall, said end cap having a housing defining an interior, said housing having an end stop and an access slot, said access slot extending generally normal to the longitudinal direction of said pair of side walls;

wherein a portion of said corrugated hurricane shutter extends through said access slot and is received within said interior and said edge of said corrugated hurricane shutter abuts said end stop to restrain against deformation and expansion of said corrugated hurricane shutter.

2. The hurricane shutter assembly of claim 1, wherein said housing includes a first wall and a second wall spaced apart from said first wall, said first wall abuts against one of said pair of side walls and said second wall abuts against the other of said pair of side walls.

3. The hurricane shutter assembly of claim 2, wherein said end stop extends generally parallel with said first wall and said second wall.

4. The hurricane shutter assembly of claim 3, wherein said housing includes an outer wall extending between said first wall and said second wall on a side opposite of said inner wall, and wherein said end stop extends generally normal to said outer wall.

5. The hurricane shutter assembly of claim 4, wherein said end stop is formed as a portion of said outer wall.

6. The hurricane shutter assembly of claim 2, wherein an inner wall extends from said first wall towards said second wall to define said access slot therebetween.

7. The hurricane shutter assembly of claim 6, wherein said inner wall has a generally arcuate shape which is convex with respect to said interior.

8. The hurricane shutter assembly of claim 7, wherein said corrugated hurricane shutter includes a first arcuate portion terminating at said edge, a second arcuate portion, and a flat portion extending between said first arcuate portion and said second arcuate portion, said flat portion abuts against an inner surface of said second wall.

9. The hurricane shutter assembly of claim 8, wherein said second arcuate portion of said corrugated hurricane shutter is positioned within said access slot.

10. The hurricane shutter assembly of claim 9, wherein said corrugated hurricane shutter includes a neutral portion adjacent said second arcuate portion, and wherein said inner wall of said housing is in biased engagement with said neutral portion to provide a non-moveable and non-deforming arrangement to restrain against deformation and expansion of said corrugated hurricane shutter.

11. A hurricane shutter assembly for protecting an opening from impact damage, said hurricane shutter assembly comprising:

an elongated header having a pair of spaced apart elongated side walls, a traverse wall connecting said pair of side walls, and an end wall positioned at either end of said pair of side walls to define a cavity;

a corrugated hurricane shutter having an edge, said corrugated hurricane shutter having a portion thereof received within said cavity of said header; and an end cap having a first wall, an end stop, and a second wall, said first wall having a portion extending toward said second wall to define an access slot therebetween, said end stop extending between and parallel to said first wall and said second wall, said end cap positioned within said cavity of said header;

wherein a portion of said corrugated hurricane shutter extends through said access slot and is received within said interior and said edge of said corrugated hurricane shutter abuts said end stop to restrain against deformation and expansion of said corrugated hurricane shutter.

12. The hurricane shutter assembly of claim 11, wherein said corrugated hurricane shutter includes a first arcuate portion terminating at said edge, a second arcuate portion, and a flat portion extending between said first arcuate portion and said second arcuate portion, said second arcuate portion is positioned within said access slot such that said first arcuate portion and said flat portion are received within said interior, and said edge of said corrugated hurricane shutter abuts said end stop to restrain against deformation and expansion of said corrugated hurricane shutter.

13. The hurricane shutter assembly of claim 12, wherein said flat portion abuts against said second wall of said end cap.

14. The hurricane shutter assembly of claim 12, wherein said corrugated hurricane shutter includes a neutral portion adjacent said second arcuate portion, and wherein said portion of said first wall which extends towards said second wall is in biased engagement with said neutral portion to provide a non-moveable and non-deforming arrangement to restrain against deformation and expansion of said corrugated hurricane shutter.

15. The hurricane shutter assembly of claim 11, wherein said first wall abuts against one of said pair of side walls and said second wall abuts against the other of said pair of side walls.

* * * * *